US005137239A

United States Patent [19]

Horton

[11] Patent Number: 5,137,239

[45] Date of Patent: Aug. 11, 1992

[54] PEG BOARD HOOK WITH BARBED PROTRUSION

[75] Inventor: Robert C. Horton, Canandaigna, N.Y.

[73] Assignee: Ultrafab, Inc., Rochester, N.Y.

[21] Appl. No.: 793,755

[22] Filed: Nov. 18, 1991

[51] Int. Cl.[5] ..... A47B 96/06

[52] U.S. Cl. ..... 248/221.2; 248/303

[58] Field of Search ..... 248/220.3, 220.4, 221.1, 248/221.2, 303, 231.9, 221.4; 411/522; 211/59.1

[56] References Cited

U.S. PATENT DOCUMENTS

| | | | |
|---|---|---|---|
| 1,767,745 | 6/1930 | Day . | |
| 2,658,248 | 11/1953 | Kost | 411/522 |
| 2,720,289 | 10/1955 | Henrickson | 411/522 X |
| 2,790,616 | 4/1957 | Cardinal . | |
| 3,037,732 | 6/1962 | Roman . | |
| 3,091,423 | 5/1963 | Butterworth . | |
| 3,226,072 | 12/1965 | Johnson . | |
| 3,425,889 | 2/1969 | Willits . | |
| 3,502,294 | 3/1970 | Kalbow | 248/220.4 |
| 3,606,225 | 9/1971 | Rasmussen . | |
| 3,682,426 | 8/1972 | Owen | 248/220.4 |
| 3,871,608 | 3/1975 | Ogden . | |
| 4,531,697 | 7/1985 | Steiner | 248/221.2 |
| 4,750,700 | 6/1988 | Wade | 211/59 X |
| 4,813,535 | 3/1989 | Radocha | 248/220.4 X |
| 4,928,912 | 5/1990 | Florek | 248/221.2 |
| 5,026,011 | 6/1991 | Hoefkes | 248/220.4 |

FOREIGN PATENT DOCUMENTS

| | | | |
|---|---|---|---|
| 861954 | 2/1941 | France | 411/522 |
| 1114701 | 5/1968 | United Kingdom . | |

*Primary Examiner*—J. Franklin Foss
*Attorney, Agent, or Firm*—Martin LuKacher

[57] ABSTRACT

A single wire or molded plastic or metal peg board hook which is inexpensive and easy to install, and which securely attaches to a standard peg board by means of spring-tension and a barbed protrusion which precludes slipping.

6 Claims, 3 Drawing Sheets

PEG BOARD HOOK WITH BARBED PROTRUSION

DESCRIPTION

The present invention relates to improvements in peg board hooks which are attachable to standard peg boards.

Peg board hooks usually comprise single or multi-element devices, which, ideally, are inexpensive, easy to install, and securely attachable to peg boards. Such hooks, however, often are deficient in one or more of those three areas.

It is the principal object of the present invention to provide an improved peg board hook by avoiding the deficiencies commonly found in such hooks.

Briefly described, a peg board hook embodying the invention makes use of a single wire or molded plastic or metal element which is shaped to form an upper end which is insertable into a peg board hole, and a protrusion, situated lower than the upper end, which is insertable into another peg board hole. A secure fit into the peg board is accomplished by means of a barbed protrusion and spring. To achieve this, the protrusion is scored along its lower surface to produce barbs which prevent the protrusion from slipping out of the peg board hole and the hook is shaped to provide a spring effect.

The foregoing and other objects, features and advantages of the invention, as well as a presently preferred embodiment thereof will become more apparent from a reading of the following description in connection with the accompanying drawings in which.

Figure 1:
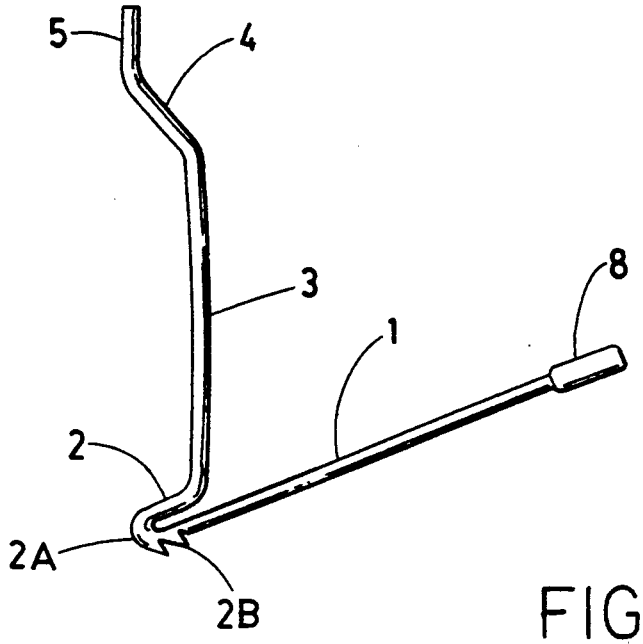
FIG 1 is a side view of a peg board hook embodying the invention.

Referring more particularly to the drawings, the peg board hook may be formed from a single metal (steel) wire having spring characteristics. The wire is bent, and as bent has a plurality of successive integral parts 1 through 5. The hook may, however, be molded from metal or plastic. As shown in FIG. 1, the lower, horizontal part 1 of the hook may be straight and defines an arm by which the hook carries objects to be mounted on a peg board 6. When the hook is made from wire, the wire is bent to form a protrusion 2A, which is the junction between parts 1 and 2. The lower surface 2B of the protrusion 2A is barbed. The wire then is bent upwardly from part 2 to form part 3 which braces the peg board hook against the peg board. Part 3 is bowed outwardly from the peg board and in effect provides an elliptical leaf spring. A second obtuse angle is formed between parts 3 and 4. Part 4 is angled back toward the peg board. Finally, part 5 of the hook forms a third obtuse angle with the fourth part by being bent in a substantially vertical direction.

Figure 2:
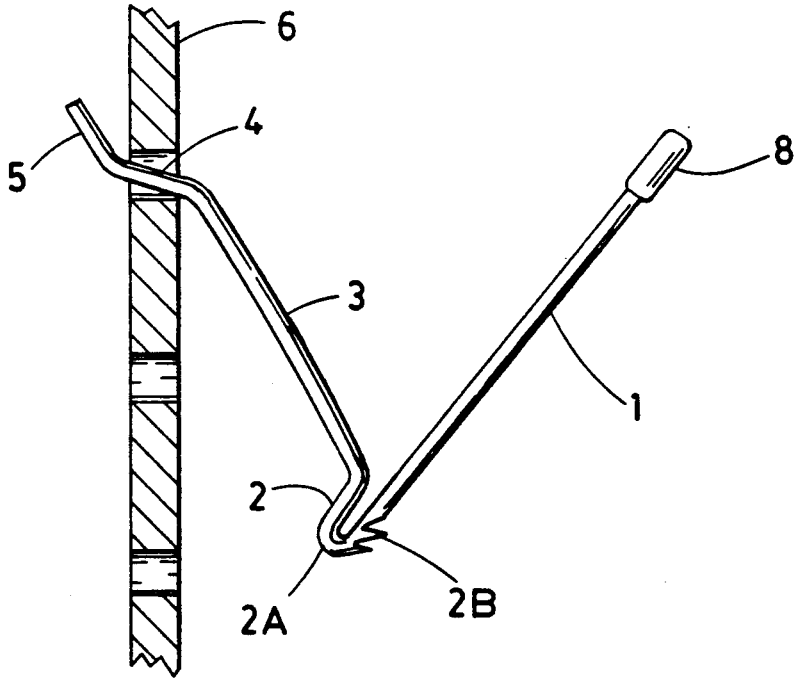
FIG. 2 is the hook of FIG. 1 being inserted into the peg board.

The bowed part 3 and barb 2B result in improved utility and operation of the hook. They work in conjunction to ensure secure fit and easy installation of the peg board hook. First, part 5 at the top of the hook is inserted into one hole of a standard peg board, as shown in FIG. 2. The protrusion 2A is then inserted into another hole disposed lower on the board than the first hole by rotating the hook in a clockwise direction on the plane in which the hook lies, about an imaginary axis perpendicular to that plane and situated in the obtuse angle joining parts 4 and 5. By rotating the entire hook, part 5 rotates toward the back surface of the peg board, there anchoring and causing part 3 to be bowed more pronouncedly to allow the protrusion 2A to be inserted in hole 2. Once inserted, the spring tension created by part 3 forces the lower edge of the protrusion 2A downward into contact with the lower half of the lower peg board hole. The spring tension forcing the barbed portion down, when coupled with the normal force presented by the lower peg board hole, creates a strong resistive force which prevents the protrusion from popping out of the lower peg board hole. See FIG. 3. The angle at which part 4 is disposed is such that part 4 contacts the peg board hole at the upper, rear portion of the hole and the lower, front portion of the hole. This contact acts to lock the hook into the peg board.

Figure 3:
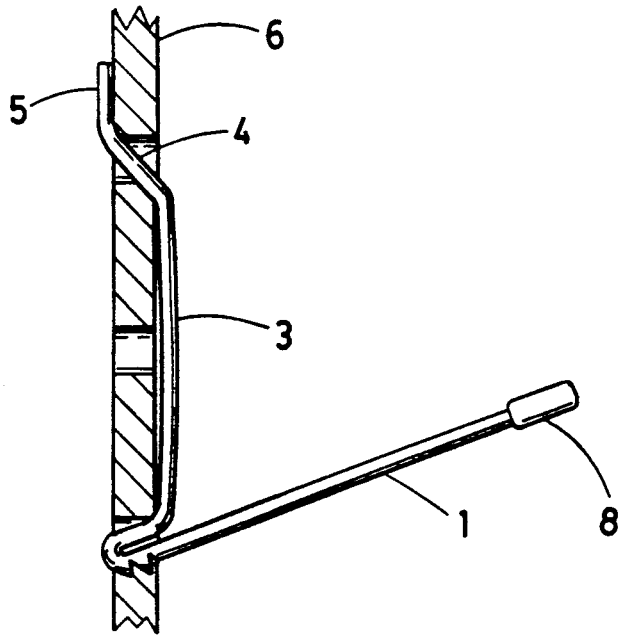
FIG. 3 is a side-view of the hook of FIG. 1 when attached to peg board.

The hook may be dipped in plastic to form a protective tip 8 on part 1, as is shown in FIG. 3. The tip 8 protects skin and clothes should they come in contact with the part 1 of the peg board hook which protrudes from the peg board 6.

Figure 4:
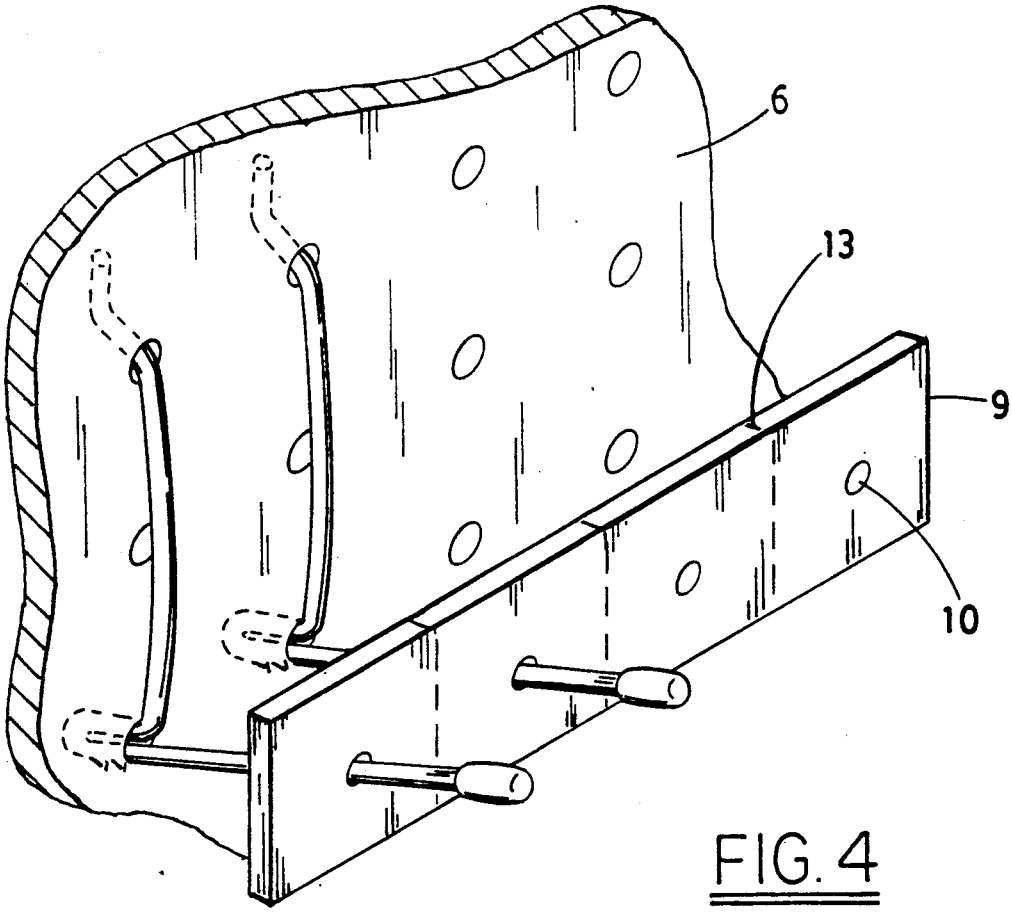
FIG. 4 is a support member with peg board hooks installed.

The support member 9 in FIG. 4 may be used to engage one or more hooks for simultaneous installation into a peg board 6. The support member 9 has a plurality of holes 10 bored therethrough, each hole being parallel with the others. The support member 9 may have perforations 13 between the parallel holes 10 which allow for separation of the support member 9 into smaller segments.

Figure 5:
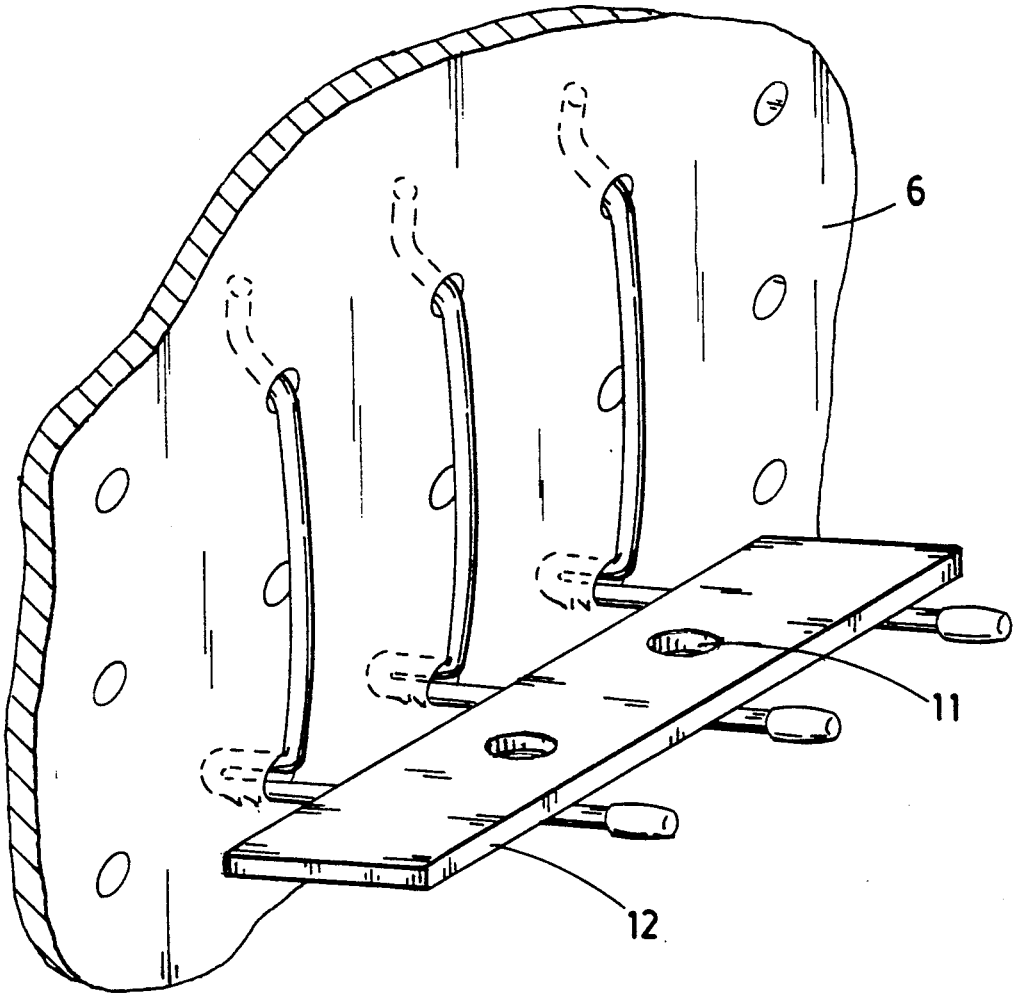
FIG. 5 is a planar sheet supported by peg boards.

As shown in FIG. 5, a plurality of hooks can be attached to a planar sheet 12, and when installed on a peg board can act as a shelf and if bored with holes 11 can support items such as screwdrivers.

From the foregoing description it will be apparent that there has been provided an improved peg board hook. While various embodiments of the invention have been described, variations and embodiments thereof within the scope of the invention will undoubtedly suggest themselves to those skilled in the art. Accordingly the foregoing description should be taken as illustrative and not in a limiting sense.

I claim:

1. A peg board hook which is received in holes in a perforated peg board having a front surface and a rear surface, said hook comprising:

a unitary rigid member of material having spring characteristics, said member having a first part forming an arm which projects from said board when said hook is supported thereon, said member also having a second part extending rearwardly from said first part and defining a straight protrusion which is received in a first hole of said peg board, said member also having a third part extending upwardly from said second part, said third part being bowed outwardly toward said arm, and said member also having a fourth part extending rearwardly away from said arm and forming an end of said third portion which is received in a second hole of said peg board spaced a distance apart less than the length of a portion of said third part, said third part being bowed and tensioned when said protrusion and said end are inserted into said first and second holes, said third part being disposed substantially parallel with said front surface, said fourth part engaging said rear surface adjacent the upper periphery of said second hole, said protrusion coming into more forceful contact with said lower periphery when weight is supported by said arm.

2. The hook according to claim 1 wherein said protrusion is scored to form barbs which engage said first hole along the lower periphery of said first hole.

3. The hook according to claim 2 wherein said barbs are located on said first part.

4. The hook according to claim 3 wherein said member is a rigid wire.

5. A hook assembly which is received in holes in a perforated peg board having a front surface and a rear surface comprising:

a plurality of hooks, each of said hooks comprising:

a unitary rigid member of material having spring characteristics, said member having a first part forming an arm which projects from said board when said hook is supported thereon, said member also having a second part extending rearwardly from said first part and defining a straight protrusion which is received in a first hole of said peg board, said member also having a third part extending upwardly from said second part, said third part being, slightly, bowed outwardly toward said arm, and said member also having a fourth part extending rearwardly away from said arm and forming an end of said third portion which is received in a second hole of said peg board spaced a distance apart less than the length of a portion of said third part, said third part being slightly bowed and tensioned when said protrusion and said end are inserted into said first and second holes, said third part being disposed substantially parallel with said front surface, said fourth part engaging said rear surface adjacent the upper periphery of said second hole, and said protrusion coming into more forceful contact with said lower periphery when weight is supported by said arm; and a member having a plurality of spaced parallel holes, said plurality of hooks each having their said first parts extending through a different one of said parallel holes for simultaneous installation of said plurality of hooks on said peg board said member thereby providing a support region defined by said first parts of said plurality of hooks.

6. The assembly according to claim 5 wherein said protrusion is scored to form barbs which engage said first hole along the lower periphery of said first hole.

* * * * *